United States Patent [19]

Logan, Jr.

[11] 4,354,561

[45] Oct. 19, 1982

[54] RECIPROCATING DRILL BIT

[75] Inventor: Clifford K. Logan, Jr., Hickory, N.C.

[73] Assignee: Bell Charles Haney, Yukon, Okla. ; a part interest

[21] Appl. No.: 180,129

[22] Filed: Aug. 21, 1980

[51] Int. Cl.[3] ..... E21B 4/08

[52] U.S. Cl. ..... 175/321; 175/381; 175/389

[58] Field of Search ..... 173/119; 175/271, 389, 175/381, 319, 379

[56] References Cited

U.S. PATENT DOCUMENTS

| | | | |
|---|---|---|---|
| 1,163,867 | 12/1915 | Shaffer . | |
| 1,505,460 | 8/1924 | Griesche . | |
| 1,572,386 | 2/1926 | Gates . | |
| 1,863,928 | 6/1932 | MacDonell | 175/381 |
| 2,203,747 | 6/1940 | Sandstone . | |
| 2,342,931 | 2/1944 | Fortune . | |
| 2,819,043 | 1/1958 | Henderson . | |
| 2,830,795 | 4/1958 | Center . | |
| 2,833,520 | 5/1958 | Owen . | |
| 2,966,949 | 1/1961 | Wepsala, Jr. | 175/329 |
| 3,024,855 | 3/1962 | Kellner | 175/379 X |
| 3,066,750 | 12/1962 | Holdebrandt | 175/381 |
| 3,227,230 | 1/1966 | Lagerstrom | 175/389 |
| 3,295,617 | 1/1967 | Willis | 175/379 |
| 3,495,359 | 2/1970 | Smith et al. | 51/204 |
| 4,230,193 | 10/1980 | Logan, Jr. | 175/379 |
| 4,289,210 | 9/1981 | Schoeffler | 175/311 |

*Primary Examiner*—William F. Pate, III

*Attorney, Agent, or Firm*—Laney, Dougherty, Hessin & Beavers

[57] ABSTRACT

A reciprocating rotary drill bit is disclosed to include a coupling member for coupling the drill bit to a source of drill bit drive power and a cutter member for drilling into a workpiece. The coupling member and the cutter member are slidably associated and include overlapping protruding portions which delimit the upward and downward travel of the cutter member with respect to the coupling member. The slidable association permits reciprocation of the cutter member with respect to the coupling member as the drill bit is rotated into the workpiece. The coupling member also includes protrusions which extend into grooves defined in the cutter member to rotationally secure the two members whereby the cutter member rotates when the coupling member rotates.

12 Claims, 6 Drawing Figures

RECIPROCATING DRILL BIT

BACKGROUND OF THE INVENTION

1. Field of the Invention

This invention relates generally to drill bits and more particularly, but not by way of limitation, to reciprocating rotary drill bits used in drilling oil or gas wells or the like.

2. Description of the Prior Art

In drilling a well, such as an oil well, a rotary drill bit is rotated into the ground by appropriate drive means to establish the well bore. Various types of rotary drill bits which accomplish this drilling are known in the art; however, of these types of rotary drill bits, I am not aware of any which also provides a reciprocating action in addition to the normal rotary action. Because the reciprocating action assists the rotary action by effectively chiseling the workpiece which is being drilled, there is the need for a drill bit which not only rotates into the workpiece, but also reciprocates as it rotates so that portions of the workpiece are chiseled by the reciprocating action as well as being drilled by the rotating action.

SUMMARY OF THE INVENTION

The present invention overcomes the above-noted and other shortcomings of the prior art by providing a novel and improved reciprocating rotary drill bit. Utilizing the present invention, one achieves both rotational drill action and chiseling action as a portion of the inventive drill bit reciprocates with respect to another portion of the bit. In other words, as the drill bit is turned into the ground by appropriate drive means, it not only conventionally bores a hole therein, but also chisels a portion of the workpiece into which the bit is being driven.

Broadly, the present invention provides a drill bit comprising a coupling member for coupling the drill bit to an appropriate power source or drill bit drive means, a cutter member for cutting into a workpiece, and means reciprocatingly connecting the cutter member to the coupling member.

The reciprocating connecting means includes a first flange extending from the coupling member toward the cutter member. The reciprocatingly connecting means further includes a second flange extending from the cutter member toward the coupling member for engaging the first flange in overlying relationship so that the flanges delimit the downward travel of the cutter member during reciprocation. The reciprocatingly connecting means also includes means for delimiting the upward travel of the cutter member during reciprocation.

The drill bit further comprises cushioning means, disposed between the first flange and the second flange, for damping the reciprocating interaction between the coupling member and the cutter member during relative movement therebetween.

The drill bit also comprises means for rotationally securing the cutter member to the coupling member when the drilling power source rotates the coupling member.

Therefore, from the foregoing it is a general object of the present invention to provide a novel and improved reciprocating rotary drill bit. Other and further objects, features and advantages of the present invention will be readily apparent to those skilled in the art when the following description of the preferred embodiments is read in conjunction with the accompanying drawings.

DETAILED DESCRIPTION OF PREFERRED EMBODIMENTS OF THE INVENTION

With reference to the drawings, the preferred embodiments of a drill bit 2 constructed in accordance with the present invention will be described. A first one of the preferred embodiments will be discussed with reference to FIGS. 1–3.

Figure 1:
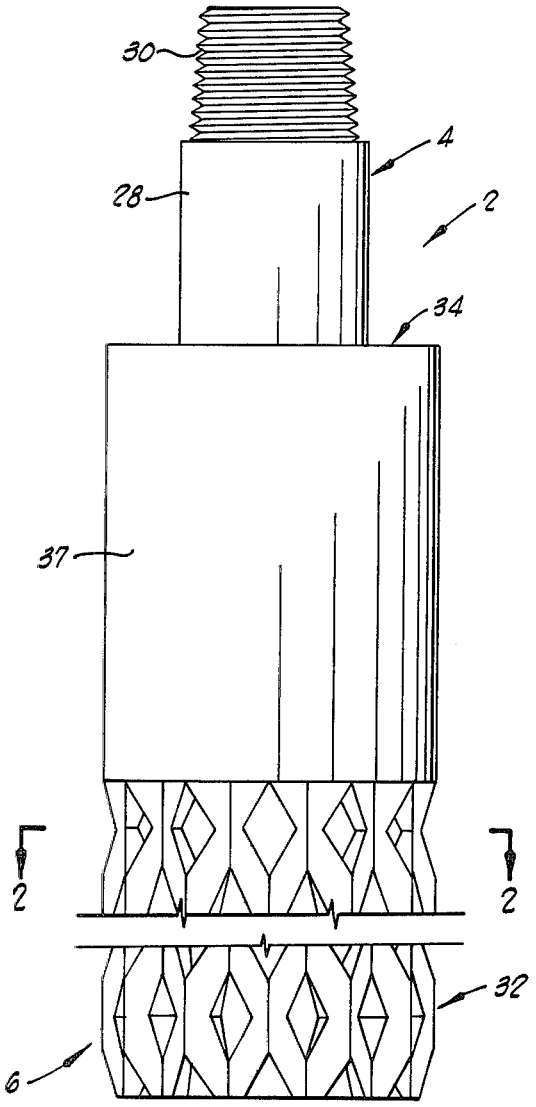
FIG. 1 is a partial elevational view of one embodiment of a drill bit constructed in accordance with the present invention.

The drill bit 2 is enclosed in FIG. 1 to include a coupling member 4 for coupling the drill bit 2 to a drill bit drive means (not shown). The drill bit drive means is of a type known in the art, such as rotational drive means used to rotate a drill string to which the drill bit 2 is to be connected for drilling an oil well. The drill bit 2 further includes a cutter member 6 for cutting into a workpiece (not shown), such as the earth. Also, the drill bit 2 includes means for reciprocatingly connecting the cutter member 6 to the coupling member 4 so that reciprocating action, in addition to the ordinary rotating action, is obtained when the drill bit drive means rotates the drill bit 2 into the workpiece.

Figure 3:
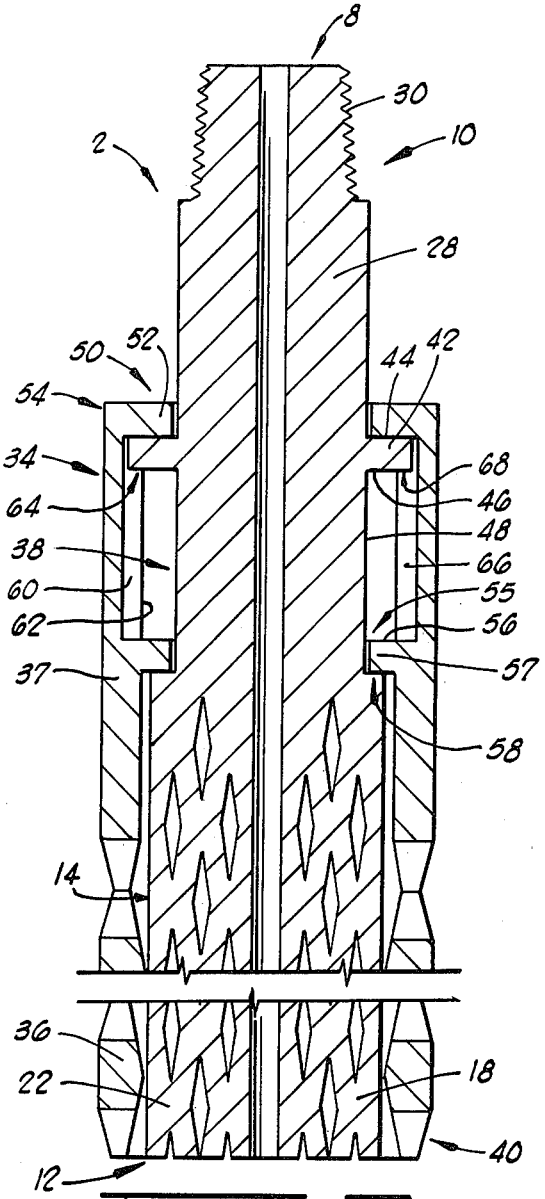
FIG. 3 is a cross-sectional elevational view of the FIG. 1 embodiment as taken along the line 3—3 shown in FIG. 2.
Figure 2:
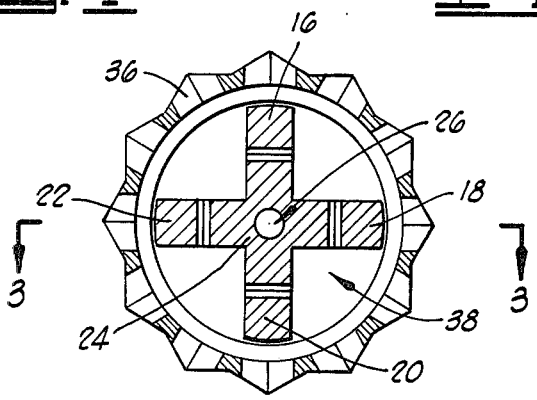
FIG. 2 is a cross-sectional view of the FIG. 1 embodiment as taken along the line 2—2 shown in FIG. 1.

As shown in FIG. 3 the coupling member 4 is embodied in the first preferred embodiment as a portion of a first elongated member 8. In particular, the coupling member 4 is formed of an upper portion 10 of the first elongated member 8. A lower portion 12 of the first elongated member 8 forms cutting means for drilling the portion of the workpiece which would otherwise extend into an outer portion of the drill bit 2 which defines the cutter member 6 and which will be subsequently described. FIG. 2 discloses that one type of cutting means includes a drilling member 14 having four drill elements 16, 18, 20 and 22 projecting outwardly from a centrally located web section 24. Extending axially through the first elongated member 8, and more particularly, through the web section 24, is a channel 26 through which appropriate drilling fluids can be injected into the hole as the drill bit 2 cuts into the workpiece.

The portion 10 of the first elongated member 8 defining the coupling member 4 shown in FIGS. 1–3 particularly includes a cylindrical wall 28 having a threaded portion 30 extending longitudinally therefrom for coupling with an appropriate mating section of the drill bit drive means. Alternatively, the coupling member 4 can include a box end or other suitable mating section for coupling with the drill bit drive means.

The cutter member 6 of the first preferred embodiment is constructed as a lower portion 32 of a second elongated member 34. A cutting element 36 of the cutter member 6 is shown in FIGS. 1–4 to have a configuration of the type disclosed in my copending U.S. patent application Ser. No. 969,810 entitled IMPROVED ROTARY DRILL BIT; however, any suitable drilling element may be used as the cutter member 6.

The second elongated member 34 is shown in FIGS. 1–3 to include a substantially cylindrical wall 37 having a cavity 38 extending therein from a first end 40 of the cylindrical wall 37. The first end 40 is particularly shown to be the lower edge of the cutter member portion 32 of the second elongated member 34. Positioned substantially concentrically within the cavity 38 is the first elongated member 8. With the first elongated member 8 so placed, the cutting means portion 12 of the first elongated member 8 drills that portion of the workpiece within the area defined substantially by the perimeter of the cavity 38 as the drill bit 2 is rotated into the workpiece by the drill bit drive means.

The means for reciprocatingly connecting the cutter member 6 to the coupling member 4 is shown in FIGS. 1–3 to include elements which are integrally formed on the first and second elongated members 8 and 34. However, other suitable means, which may be non-integrally formed with the elongated members, can be used. These elements provide means for delimiting the downward travel of the second elongated member 34 with respect to the first elongated member 8 and also provide means for delimiting the upward travel of the second elongated member 34 with respect to the first elongated member 8. The downward and upward movement occurs in the preferred embodiment during reciprocation of the second elongated member with respect to the first elongated member.

The downward travel delimiting means includes a first protruding portion 42 extending from the first elongated member 8 and having a first surface 44 and a second surface 46 which both extend away from a side surface 48 of the first elongated member 8 from which the protruding portion 42 protrudes. The downward delimiting means further includes a second protruding portion 50 extending from the second elongated member 34 toward the first elongated member 8 in overlapping relationship with the first surface 44 of the first protruding portion 42. More particularly, the first protruding portion 42 defines a first flange associated with the coupling member 4 and the second protruding portion 50 defines a second flange associated with the cutter member 6. The two flanges overlap so that the first flange delimits the downward travel of the second elongated member 34 (and thus the cutter member portion 32 thereof) during reciprocation. For the embodiment shown in FIGS. 1–3 the second protruding portion 50 includes an inwardly projecting rim 52 positioned at a second end 54 which is opposite the lower end 40 of the second elongated member 34 to which the cutter member portion 32 extends. The rim 52 extends inwardly, adjacent the first elongated member 8, so that the first and second elongated members 8 and 34 are slidingly engaged and so that the rim 52 contacts the first surface 44 of the first protruding portion 42 and thereby delimits the downward travel of the second elongated member 34 during reciprocation.

The upward travel delimiting means includes the second surface 36 of the first protruding portion 42 of the first elongated member 8 and also includes a third protruding portion 55 which extends from the second elongated member 34 toward the first elongated member 8 and which defines a fourth surface 56 facing the second surface 46 of the first protruding portion 42. The third protruding portion 55 is spaced from the second protruding portion 50 of the second elongated member 34 so that the second elongated member 34 is slidably associated with the first elongated member 8 and is delimited in its slidable association by the interaction of the overlapping first, second and third protruding portions 42, 50 and 55.

As shown in FIG. 3, the third protruding portion 54 particularly includes an annular collar 57 spaced from the rim 52 of the second elongated member 34. The collar 56 circumferentially extends around the cavity 38 defined in the member 34. FIG. 3 further shows that the collar 56 interacts in its lowermost position with a shoulder 58 defined by the outwardly extending drilling elements 16–22 of the cutting means of the first elongated member 8. It is to be noted that this interaction between the shoulder 58 and the collar 56 is unnecessary to delimit the travel of the first and second elongated members because delimiting is achieved by means of the first, second and third protruding portions.

Because the second elongated member 34 is slidably associated along the axial direction with the first elongated member 8, the drill bit 2 includes the means for rotationally securing the two members 8 and 34 so that the second elongated member 34 rotates with the first elongated member 8 when the drill bit drive means rotates the first elongated member 8. For the embodiment shown in FIGS. 1–3, the rotationally securing means includes a longitudinally extending groove 60 formed in a surface 62 of the second elongated member 34 defining the cavity 38. The rotationally securing means further includes a protruding portion or rib 64 extending from the first elongated member 8 into rotational securement with the groove 60. The embodiment of FIGS. 1–3 is also shown to include a second groove 66 and a second protruding portion or rib 68. The manner in which the protruding ribs and grooves interact to provide rotationally securing means is more particularly shown in the third embodiment of the present invention shown in FIG. 6.

Figure 4:
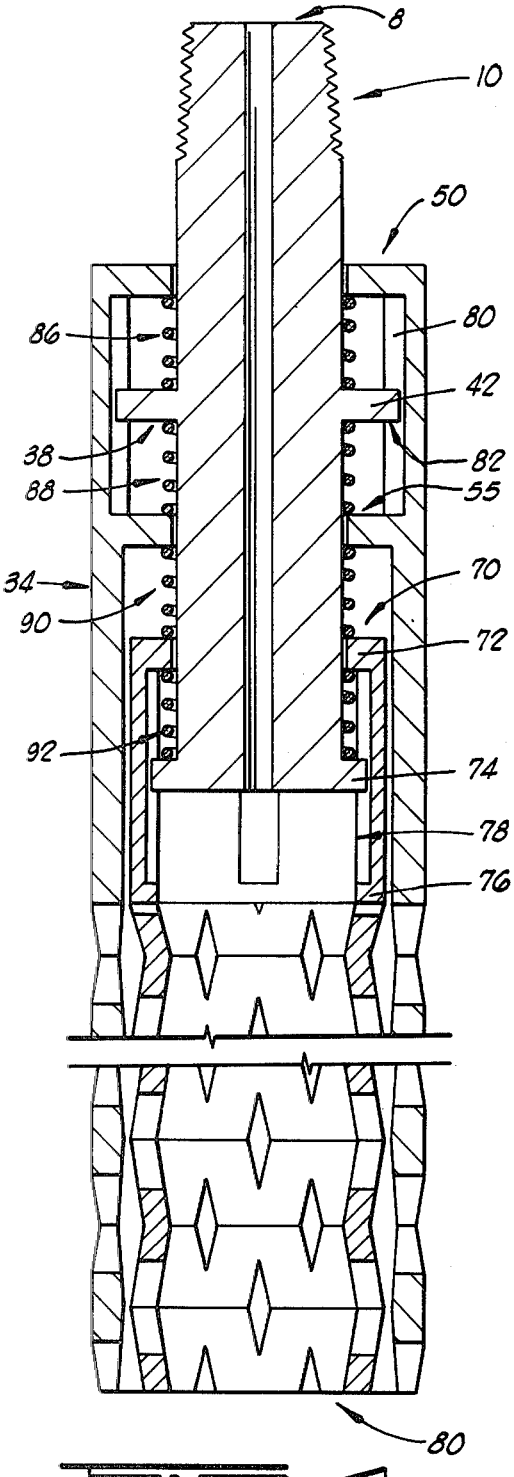
FIG. 4 is a cross-sectional elevational view of a second preferred embodiment of the drill bit constructed in accordance with the present invention.
Figure 5:
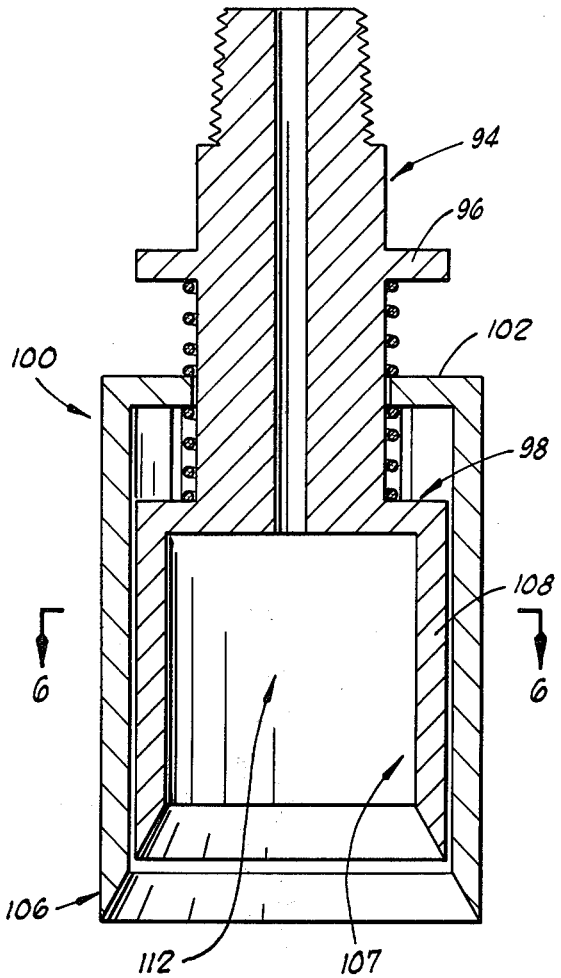
FIG. 5 is a cross-sectional elevational view of a third embodiment of the drill bit constructed in accordance with the present invention.
Figure 6:
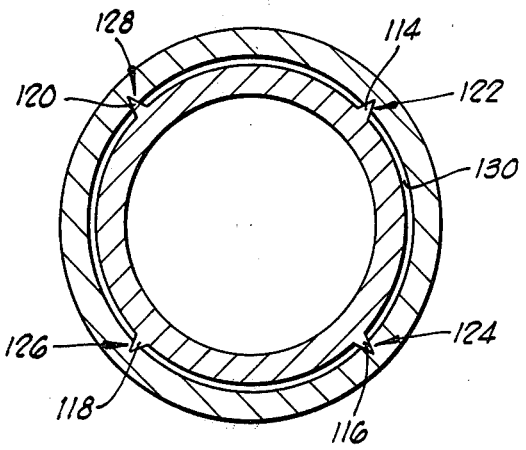
FIG. 6 is a cross-sectional plan view of the FIG. 5 embodiment of the drill bit as taken along the line 6—6 shown in FIG. 5.

Although the embodiment shown in FIGS. 1–3 is not illustrated as including cushioning means for damping the reciprocating interaction between the first and second elongated members 8 and 34 during relative movement therebetween, such cushioning means may be included therein in a manner similar to that in which the cushioning means is shown disclosed in the embodiments of FIGS. 4–6.

The second preferred embodiment of the drill bit 2, which is disclosed in FIG. 4, is constructed similarly to the embodiment shown in FIGS. 1–2. However, the FIG. 4 embodiment further includes a third elongated member 70 having a flange 72 extending toward the first elongated member 8 in overlapping relation with a flange 74 which extends from the member 8 and which is spaced from the first protruding portion 42 on the side thereof which is opposite the coupling member portion 10. The third elongated member 70 is slidably associated with the portion of the first elongated member 8 which extends between the third protruding portion 55 of the second elongated member 34 and the lower flange 74 of the first elongated member 8. The third elongated member 70 has a substantially cylindrical wall 76 with a second cavity 78 extending therein from an end 80 of the cylindrical wall 76. The elongated member 70 is disposed substantially concentrically within the first cavity 38 of the second elongated member 34. The first elongated member 8 is disposed substantially concentrically within both the first and second cavities 38 and 78 as shown in FIG. 4.

So that the third elongated member 70 will rotate when the first and second elongated members 8 and 34 rotate, the rotationally securing means for the FIG. 4 embodiment further includes an appropriate groove 80 and projecting portion, or rib, 82 similar to those which rotationally secure the first and second elongated members 8 and 34.

Although not shown in FIG. 4, the first elongated member 8 includes means for cutting the portion of the workpiece within the area substantially defined by the perimeter of the second cavity 78 formed in the third elongated member 70. This cutting means may be of the type disclosed with respect to the first preferred embodiment or of any other suitable type.

The second preferred embodiment of the drill bit 2 shown in FIG. 4 further includes cushioning means for damping the reciprocating interaction between the respective elongated members. In particular, the cushioning means includes first longitudinally extending biasing means 86 disposed between the first protruding portion 42 of the first elongated member 8 and the second protruding portion 50 of the second elongated member 34, second longitudinally extending biasing means 88 disposed between the first protruding portion 42 of the first elongated member 8 an the third protruding portion 55 of the second elongated member 34, third longitudinally extending biasing means 90 disposed between the third protruding portion 55 of the second elongated member 34 and the flange 72 of the third elongated member 70, and fourth longitudinally extending biasing means 92 disposed between the flange 72 of the third elongated member 70 and the flange 74 of the first elongated member 8. Specifically, the biasing means 86–92 are disclosed to be springs.

The third preferred embodiment of the drill bit 2 constructed in accordance with the present invention is disclosed in FIGS. 5 and 6. This embodiment of the drill bit 2 is constructed similarly to the first preferred embodiment, except a first elongated member 94 of the third embodiment includes two outwardly extending shoulder portions 96 and 98 for delimiting the upward and downward travel of a reciprocating second elongated member 100 by interacting with a single inwardly extending collar 102 of the second elongated member 100. Additionally, FIGS. 5 and 6 disclose a different type of cutter member 106 and cutting means 107. The cutting means 107, extending downward as a lower portion 108 of the first elongated member 94, includes a cavity 112 similar to the second cavity 78 defined by the third elongated member 70 of the FIG. 4 embodiment. The cutting means 107 may further include an element such as the one shown in FIG. 2 to bore the workpiece within the region defined by the perimiter of the cavity.

FIG. 6 shows the rotational securement between a plurality of protuberances or ribs 114, 116, 118 and 120 extending outward from the first elongated member 94 into engagement with a plurality of corresponding longitudinally extending grooves 122, 124, 126 and 128 formed within a surface 130 of the second elongated member 100.

The elongated members, and more particularly the coupling members and cutter members, disclosed in the drawings and described above can be made of any suitable material and weight as is known in the art. However, it is to be noted that varying the weight of the cutter member can change the force necessary to reciprocate the cutter member upward and can affect the downward force exerted by the cutter members during the drilling process.

With reference primarily to the embodiment shown in FIGS. 1–3, the operation of the present invention will be described. Once the drill bit 2 has been appropriately connected to the drill bit drive means and the drill bit drive means has been actuated to rotate the first elongated member 8, the entire drill bit 2 will rotate because of the rotational securement between the first elongated member 8 and the second elongated member 34. As the drill bit 2 is rotated and is placed in contact with the workpiece to be drilled, the drill bit 2 will conventionally bore a hole in the workpiece. Additionally, as the drill bit 2 rotates the slidably associated second elongated member 34 moves upward when it encounters suitably opposing portions of the workpiece. As the drill bit 2 rotates and overcomes the opposing portion, the second elongated member 34 travels downward under its own weight (or by means of the biasing means, if any) so that the cutter member 6 of the second elongated member 34 slams into the workpiece and thereby chisels a portion thereof. Thus, by means of this upward and downward movement of the second elongated member 34 (and any other slidably associated elongated members such as the third one shown in FIG. 4), the reciprocating action is achieved to add a longitudinal chiseling effect to the conventional rotary effect of the drill bit.

From the FIG. 4 embodiment it will be understood that a plurality of reciprocating elongated members can be associated with the first elongated member. The FIG. 4 embodiment and the FIGS. 5–6 embodiment disclose that by using the biasing elements as cushioning means, the shock which would otherwise occur when the respective protruding portions bang into each other during reciprocation can be damped or totally eliminated.

Thus, the present invention of a reciprocating rotary drill bit is well adapted to carry out the objects and attain the ends and advantages mentioned above as well as those inherent therein. While preferred embodiments of the invention have been described for the purpose of this disclosure, numerous changes in the construction and arrangement of parts can be made by those skilled in the art, which changes are encomposed within the spirit of this invention as defined by the appended claims.

What is claimed is:

1. A drill bit, comprising:

a coupling member for coupling said drill bit to a drill bit drive means;

a cutter member for drilling into a workpiece; and means for reciprocatingly connecting said cutter member to said coupling member, said means including:

a first flange associated with said coupling member and extending toward said cutter member; and a second flange associated with said cutter member and extending toward said coupling member for overlying engagement with said first flange so that said first flange delimits the downward travel of said cutter member during reciprocation of said cutter member with respect to said coupling member; and cushioning means, disposed between said first flange and said second flange, for damping the reciprocating interaction between said coupling member and said cutter member during relative movement therebetween.

2. A drill bit as defined in claim 1, wherein said drill bit further comprises means for rotationally securing said cutter member to said coupling member so that said cutter member rotates with said coupling member when the drill bit drive means rotates said coupling member.

3. A drill bit as defined in claim 2, wherein said reciprocatingly connecting means further includes means for delimiting the upward travel of said cutter member during reciprocation.

4. A reciprocating rotary drill bit, comprising:

a first elongated member having a side surface, including:

a coupling portion for coupling with a drill bit drive means; and a first protruding portion defines a first surface and a second surface, both surfaces extending away from the side surface of said first elongated member from which said first protruding portion protrudes;

a second elongated member, including:

a cutter portion for drilling into a workpiece;

a second protruding portion extending toward said first elongated member in overlying relationship with the first surface of said first protruding portion; and a third protruding portion extending toward said first elongated member in overlapping relationship with said first protruding portion, said third protruding portion defining a fourth surface substantially facing the second surface of said first protruding portion, and said third protruding portion being spaced from said second protruding portion so that said second elongated member is slidably associated with said first elongated member and is delimited in its slidable association by the interaction of said overlapping first, second and third protruding portions;

first longitudinally extending biasing means disposed between said first protruding portion and said second protruding portion; and second longitudinally extending biasing means disposed between said first protruding portion and said third protruding portion.

5. A drill bit as defined in claim 4, wherein said drill bit further includes means for rotationally securing said second elongated member to said first elongated member so that said second elongated member rotates when said drill bit drive means rotates said first elongated member.

6. A drill bit as defined in claim 5 wherein:

said second elongated member includes a longitudinally extending groove formed along the surface of said second elongated member defining said cavity, said groove forming a part of said rotationally securing means; and said rotationally securing means further includes a fourth protruding portion extending from said first elongated member into rotational securement with said groove.

7. A reciprocating rotary drill bit, comprising:

a first elongated member having a side surface, including:

a coupling portion for coupling with a drill bit drive means;

a first protruding portion defining a first surface and a second surface, both surfaces extending away from the side surface of said first elongated member from which said first protruding portion protrudes; and a first flange extending therefrom and spaced from said first protruding portion on the side thereof opposite said coupling portion;

a second elongated member, including:

a cutter portion for drilling into a workpiece;

a second protruding portion extending toward said first elongated member in overlying relationship with the first surface of said first protruding portion; and a third protruding portion extending toward said first elongated member in overlapping relationship with said first protruding portion, said third protruding portion defining a fourth surface substantially facing the second surface of said first protruding portion, and said third protruding portion being spaced from said second protruding portion so that said second elongated member is slidably associated with said first elongated member and is delimited in its slidable association by the interaction of said overlapping first, second and third protruding portions; and a third elongated member having a second flange extending toward said first elongated member in overlapping relation with said first flange and slidably associated with the portion of said first elongated member extending between said third protruding portion of said second elongated member and said first flange.

8. A drill bit as defined in claim 7, wherein:

said second elongated member has a substantially cylindrical wall having a first cavity extending therein from one of the ends thereof;

said third elongated member has a substantially cylindrical wall having a second cavity extending therein from one of the ends thereof and said third elongated member is disposed substantially concentrically within said first cavity; and said first elongated member is disposed substantially concentrically within said first and second cavities.

9. A drill bit as defined in claim 8, wherein said drill bit further comprises:

first longitudinally extending biasing means disposed between said first protruding portion and said second protruding portion;

second longitudinally extending biasing means disposed between said first protruding portion and said third protruding portion;

third longitudinally extending biasing means disposed between said third protruding portion of said second elongated member and said second flange of said third elongated member; and fourth longitudinally extending biasing means disposed between said second flange of said third elongated member and said first flange of said first elongated member.

10. A drill bit as defined in claim 9, wherein said drill bit further comprises means for rotationally securing said second elongated member and said third elongated member to said first elongated member so that said second and third elongated members rotate when said drill bit drive means rotates said first elongated member.

11. A drill bit as defined in claim 10, wherein said first elongated member includes means for cutting the workpiece within substantially the area defined by the perimeter of said second cavity.

12. A reciprocating rotary drill bit, comprising:

a first elongated member having a side surface, including:

a coupling portion for coupling with a drill bit drive means so that said first elongated member is rotatable by the drill bit drive means; and a first protruding portion defining a first surface and a second surface, both surfaces extending away from the side surface of said first elongated member from which said first protruding portion protrudes; and a second elongated member having an inner surface, including:

a cutter portion for drilling into a workpiece;

a second protruding portion extending toward said first elongated member in overlying relationship with the first surface of said first protruding portion;

a third protruding portion extending toward said first elongated member in overlapping relationship with said first protruding portion, said third protruding portion defining a fourth surface substantially facing the second surface of said first protruding portion, and said third protruding being spaced from said second protruding portion so that said second elongated member is slidably associated with said first elongated member and is delimited in its slidable association by the interaction of said overlapping first, second and third protruding portions; and a longitudinally extending groove formed along the inner surface; and a fourth protruding portion extending from said first elongated member into rotational securement with said groove.

* * * * *

UNITED STATES PATENT AND TRADEMARK OFFICE

CERTIFICATE OF CORRECTION

PATENT NO. : 4,354,561

DATED : October 19, 1982

INVENTOR(S) : Clifford K. Logan, Jr.

It is certified that error appears in the above-identified patent and that said Letters Patent are hereby corrected as shown below:

Column 2, line 30, "enclosed" should be --disclosed--; Column 3, line 67, "36" should be --46--; Column 7, line 22 (Claim 4, line 6), "defines" should be --defining--.

Signed and Sealed this

*Eleventh* Day of *January 1983*

[SEAL]

*Attest:*

GERALD J. MOSSINGHOFF

*Attesting Officer*

*Commissioner of Patents and Trademarks*